United States Patent [19]

Hildebrand

[11] 3,954,388

[45] May 4, 1976

[54] GAS BURNER AND FURNACE

[76] Inventor: Kornelius Hildebrand, 1523 E. Jefferson, Park Crest Apts., Apt. 416, Detroit, Mich. 48207

[22] Filed: Dec. 6, 1974

[21] Appl. No.: 530,416

[52] U.S. Cl. ..... 431/329; 431/170; 126/92 AC

[51] Int. Cl.[2] ..... F23D 13/14

[58] Field of Search ..... 431/328, 329, 170; 432/156–158, 173, 175; 126/92 AC, 92 B, 92 C

[56] References Cited

UNITED STATES PATENTS

| | | | |
|---|---|---|---|
| 1,225,381 | 5/1917 | Wedge | 431/328 |
| 3,188,366 | 6/1965 | Flynn | 431/329 |
| 3,199,570 | 8/1965 | Williams et al. | 431/329 |
| 3,199,573 | 8/1965 | Flynn | 431/329 |
| 3,208,247 | 9/1965 | Weil et al. | 431/328 |
| 3,216,478 | 11/1965 | Saunders et al. | 431/329 |
| 3,391,983 | 7/1968 | Harazone et al. | 431/329 |
| 3,751,213 | 8/1973 | Sowands | 431/328 |
| 3,833,338 | 9/1974 | Badrock | 431/329 |
| 3,852,025 | 12/1974 | Placek | 126/92 B |

*Primary Examiner*—John J. Camby
*Assistant Examiner*—Henry C. Yuen
*Attorney, Agent, or Firm*—Harness, Dickey & Pierce

[57] ABSTRACT

A gas burner for industrial furnaces, such as launders, crucible melting furnaces, dry hearth breakdown furnaces, holding furnaces and the like, wherein the burner comprises a relatively narrow elongated strip of porous refractory material through which the gaseous fuel/air mixture passes. The strip is made wide enough to pass the required quantity (heat value) of fuel, but not so wide that the flow of fuel/air mixture through the burner is not great enough to cool the burner sufficiently to maintain the fuel temperature below its flash point. The burner strip is preferably as narrow as possible to expose a minimum degree of surface area to the back radiation and convection heat from the furnace interior.

18 Claims, 2 Drawing Figures

Fig. 1.
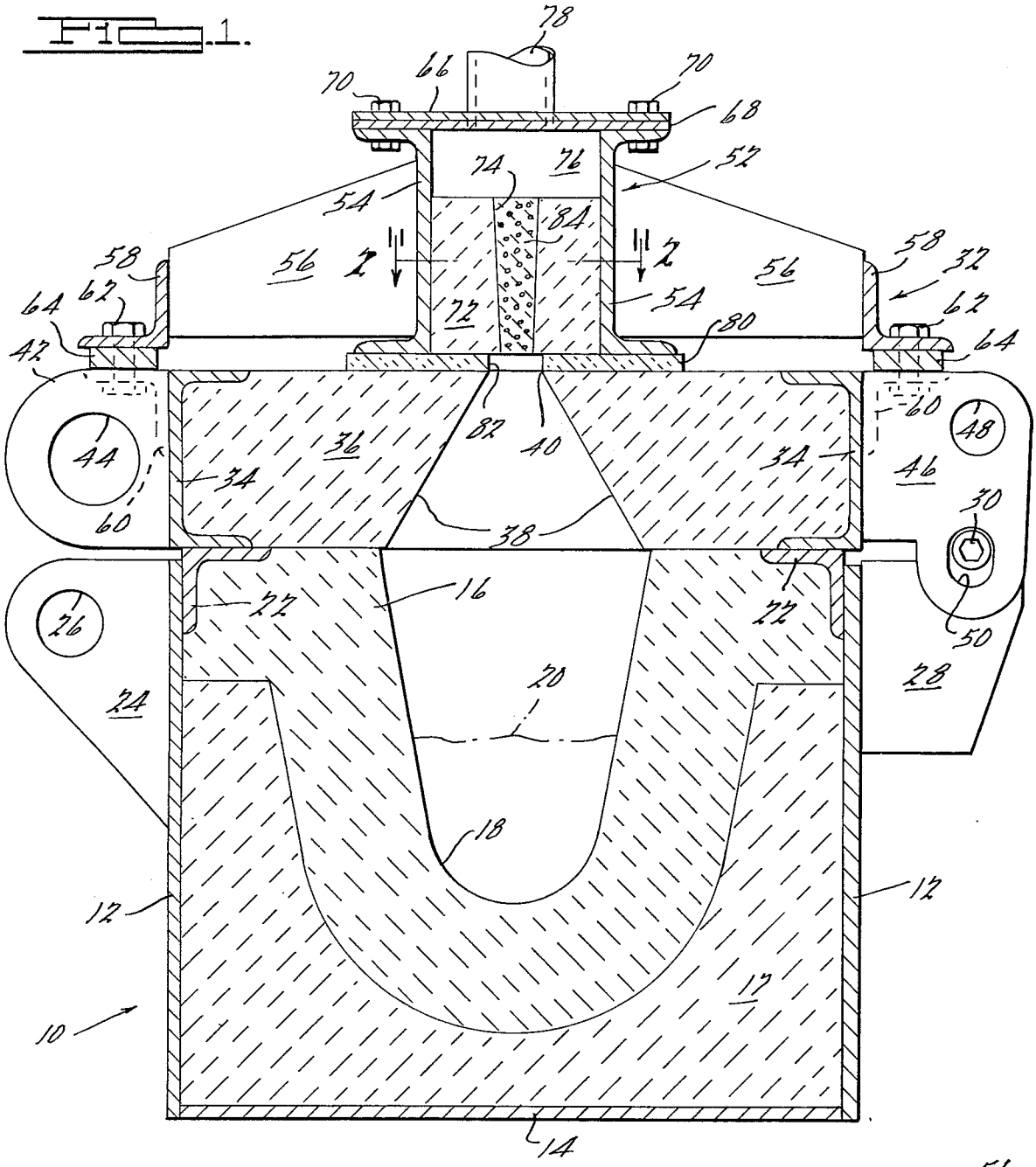
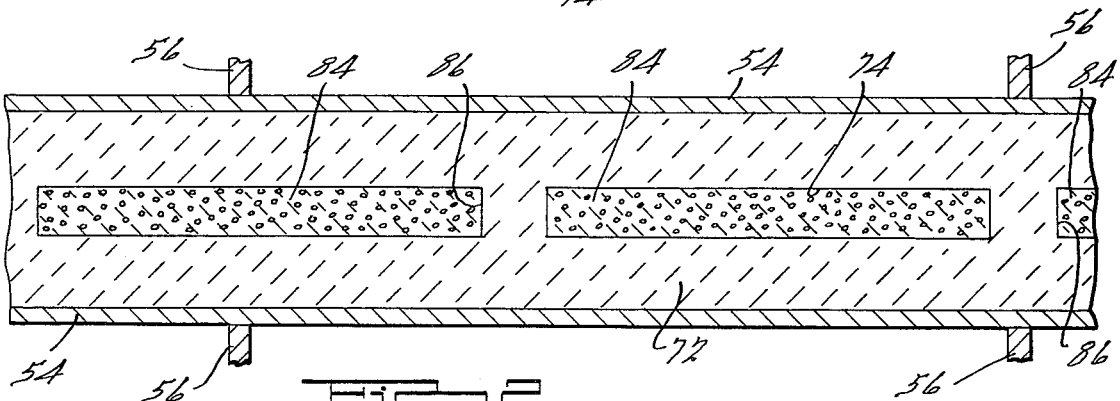
Fig. 2.

GAS BURNER AND FURNACE

BACKGROUND AND SUMMARY OF THE INVENTION

Although the burner of the present invention is suitable for use in a number of different furnaces, it will be described for illustrative purposes embodied in a launder, such as one used to convey molten brass from a melting furnace to a holding furnace and automatic casting machine.

Known launders conventionally use a plurality of gun type burners which shoot a high velocity flame onto the surface of the flowing molten metal. These burners not only consume relatively large quantities of fuel, but also, because of the direct impingement of the flame upon the surface of the molten metal, cause the latter to oxidize and/or constituents of an alloy to be burned out. Furthermore, this direct impingement causes erosion of the refractory lining, which results in pockets being formed therein in which pools of molten metal collect at the end of a run, the metal in these pools being further oxidized and/or burned by the flames so that they contaminate the next run. In addition, most launders are so constructed that they must be run twenty-four hours a day because it would take too long to bring them up to temperature at the beginning of a day.

The burner of the present invention has as its object overcoming these disadvantages of known burners, in launders as well as other furnaces which suffer from the same problems. This is accomplished by utilizing a relatively narrow strip of porous refractory material which breaks the flame up into a large number of relatively small low-velocity flames which are spread over a strip of finite width which extends for substantially the full extent of the combustion chamber in at least one direction. The heat is therefore very evenly distributed. Because of the reduced velocity there is no undesirable impingement of the flame directly on the molten metal, and furthermore the heat of combustion is retained in the furnace for a longer time than with high velocity gun type burners (which force a great deal of heat up the stack), thus permitting the heated material to absorb more of the heat generated by a unit of fuel, whereby thermal efficiency is increased and fuel consumption reduced. The present invention has as a further object the provision of an improved launder construction, and one which can be turned off at night, thus reducing fuel consumption, fire hazard, insurance rates and the like.

Another object of the present invention resides in the provision of an improved burner which itself receives maximized cooling, by having a minimum of surface area exposed to the radiant and convective heat in the combustion chamber, thus improving reliability and life. A related object concerns the provision of such a burner which has a relatively large dimension in the direction of fuel flow, whereby flash backs are prevented and thorough fuel/air mixing is insured.

Another object of the present invention resides in the provision of an improved porous refractory type burner which does not require special surface treatment to increase the reflectivity and reduce the heat absorption qualities thereof, thus facilitating cooling and reducing the production of infra red radiation.

Another object of the present invention resides in the provision of a furnace having a minimum surface area in the combustion chamber, whereby the degree of heating by convection is increased and amount of radiation is reduced, whereby thermal efficiency is improved.

Another object of the present invention resides in the provision of a furnace which does not require the use of excess air for solely cooling purposes.

BRIEF DESCRIPTION OF THE DRAWINGS

FIG. 1 is a transverse sectional view through a launder embodying the principles of the present invention; and FIG. 2 is a fragmentary sectional view taken along line 2—2 in FIG. 1.

DETAILED DESCRIPTION OF THE PREFERRED EMBODIMENT

Although the burner in the furnace of the present invention may be adapted for use in a number of different furnace environments, it is shown herein for illustrative purposes in the form of a launder of the type used for conveying molten metal from a melting furnace to a holding furnace and/or casting machine. Generally speaking, the launder is of elongated construction consisting, in simplest terms, merely of a heated trough for conveying the molten metal between the desired stations. Since launders are conventionally of substantially uniform cross-section only a single transverse cross-section is illustrated in the drawings.

With reference to FIG. 1, the launder comprises a steel casing 10 having side walls 12 and a bottom wall 14. Disposed within the open mouth of casing 10 is a launder liner 16 defining an upwardly open trough 18 which is normally longitudinally inclined to convey the molten liquid metal, indicated in phantom at 20, longitudinally from one end to the other. Liner 16 is formed of a conventional material, such as a relatively dense refractory material (e.g. in the order of 180 pounds per cubic foot). Disposed between liner 16 and casing 10 is insulation material 17, such as a relatively light weight refractory insulation (e.g. in the order of 90 pounds per cubic foot), which serves to thermally insulate the liner from the atmosphere. Longitudinally extending reinforcing and framing elements 22 may be provided. Casing 10 may be provided along one side with longitudinally spaced transversely extending projections 24 having openings 26 therein which serve as lifting lugs, and on the opposite side a plurality of spaced projections 28 having pivotal elements 30 which serve to pivotally support the launder cover, indicated generally at 32.

Cover 32 comprises longitudinally extending side structural elements 34, which may be in the form of channel irons as shown, between which is positioned a body 36 of relatively dense refractory material, similar to that of liner 16. Body 36 is provided with a centrally disposed longitudinally extending slot defined by upwardly converging surfaces 38 which define at the upper surface of the cover an elongated longitudinally extending slot 40. The upper surface of the launder liner is complementary to the lower surface of the cover so that when the cover is in place, as illustrated in FIG. 1, the combustion chamber is defined by surfaces 38 and the walls of trough 18. Cover 32 is also provided on one side with a plurality of longitudinally spaced projections 42 having openings 44 therein which serve as lifting lugs, and on the opposite side with a plurality of projections 46 having lifting lug openings 48 and hinge openings 50 cooperatable with elements 30 to provide a hinging action for opening the launder cover.

Affixed to the top of cover 32 is the burner assembly of the present invention, indicated generally at 52. Burner assembly 52 comprises longitudinally extending side casing elements or members 54, which may be channel elements as shown, to which are affixed a plurality of longitudinally spaced transversely extending ribs 56 which are attached by means of structural elements 58 to a pair of corresponding elements 60 extending longitudinally along the upper edges of cover 32, as by means of threaded fasteners 62. If desired, suitable spacers 64 may be disposed therebetween. Disposed along the top of casing members 54 is a top plate 66 which is sealed with respect to members 54 by means of an insulating gasket 68. Conventional threaded fasteners 70 may be used to hold the assembly together.

Disposed between members 54 is a body 72 of relatively light weight insulating meterial, such as insulation 17, having a longitudinally extending vertical slot 74 therethrough. The upper surface of body 72 is spaced from top plate 70 to define a plenum chamber 76 into which a gaseous fuel/air mixture is forced in the conventional manner by means of a supply pipe 78. Natural gas, manufactured gas, or the like, may be used as fuels and are mixed with the proper amount of air in the usual manner prior to reaching supply pipe 78. The lower surface of body 72 is substantially flush with members 54 and compressively engages a sealing and insulating gasket 80 which is sealingly disposed between the burner and launder cover. Gasket 80 may be formed of a fiberous material such as diatomacious silica, and is provided therethrough with a longitudinally extending slot 82 so positioned as to place the lower end of slot 74 in communication with slot 40 and the combustion chamber.

The burner itself, indicated at 84, is in the form of an elongated strip of substantially uniform cross-section and is disposed within and extends for the full longitudinal extent of slot 74. Burner 84 is tapered in cross-section as can be seen in FIG. 1, in order to prevent its dropping into the furnace in the event of shrinkage at high heats. Because of its tapered shape it not only is prevented from dropping out of place but is also maintained always in sealing engagement with body 72. As can be seen in FIG. 2, although slot 74 extends substantially the full longitudinal extent of the launder, there may be interruptions therein, as at 86, in order to provide sufficient strength. In any case, each of the burners should extend for the full longitudinal and transverse extent of each of the slots in which it is disposed. As can be visualized, the fuel will burn in a large number of relatively low-velocity flames extending downwardly from the bottom face of burner 84.

The burner may be formed of any appropriate porous refractory material, of which a number are well known, the improvement residing more in the shape of the burner. These materials may comprise fire-clay and sawdust with the latter burned out, coarse grains of refractory cemented together, sintered or fused refractory materials, or the like. The most important criteria in determining the shape of the burner strip is its capacity to be maintained sufficiently cool that the fuel passing therethrough will not be heated to its flash point.

The shape of the burner of the present invention is arrived at by striking a balance between a number of parameters. Firstly, the burner should extend for substantially the full length of the combustion chamber in order to provide even heat throughout the longitudinal extent thereof. Secondly, the burner should be of the smallest possible transverse width capable of passing the quantity of fuel required for operation of the furnace, which is established by known criteria. If the burner is made too wide, insufficient cooling will result because it is the fuel/air mixture (which is cold relative to the temperature of the interior of the furnace) which provides the primary cooling function. Thus, if the burner was unnecessarily wide the amount of gas passing through each unit area would be less than that necessary for the cooling desired. Thirdly, the burner should be sufficiently thick in the direction of gas flow to prevent flame flash back and to provide a thorough mixing of the fuel and air, the latter being accomplished by the relatively long, tortuous path through which each fuel and air molecule must flow as they traverse through the interior of the porous refractory constituting the burner. The porous refractory is also preferably of uniform density and porosity throughout its thickness. It has been found in practice that the burner should be at least 3½ inches thick in the direction of gas flow. Fourthly, the total effective area of the passageways through the porous refractory of the burner should be at least as great as the cross-sectional area of the gas supply pipe and preferably in the order of 150 percent thereof. If the area of the burner openings is less than the area of the supply pipe than the inlet gas will tend to stagnate, causing a substantial reduction in the cooling effect created thereby, especially along the top of the burner. On the other hand, if the area of the burner is too large (i.e. substantially greater than 150 percent of that of the supply pipe) then there will be insufficient gas flow to provide the necessary cooling.

The shape of the combustion chamber and the positioning of the burner also contribute to the cooling of the latter. Note that the burner is disposed wholly outside of the furnace, i.e. above the top of the cover in the case of a launder, as far away from the intense heat in the combustion chamber as is possible without actually enlarging the combustion chamber. Furthermore, the hot face of the burner, i.e. the lower surface as seen in FIG. 1, is exposed to the combustion chamber solely through the slots 40 and 82 which are only slightly wider than the hot face of the burner itself, thus exposing a minimum amount of the burner to the intense heat within the combustion chamber. Tapered surfaces 38 contribute greatly to accomplish this. Mounting the burner wholly outside of the furnace permits ambient air to circulate all around it to assist in cooling. In extreme cases, if desired, a water jacket may also be provided around the steel casing for the burner in order to further cool the same to insure that the fuel passing therethrough does not reach its flash point, i.e. the point at which it breaks up into its constituents and no longer acts as a fuel.

By way of example, the present invention has been embodied in a launder for conveying molten brass from a melting furnace to a casting machine. The launder had a cross-sectional configuration substantially the same as that shown in FIG. 1 and was in the order of six feet long. Each of the burners 84 was approximately three-fourth of an inch wide at the hot face, one inch wide at the upper face and was approximately one foot long, three such burners being arranged in end-to-end equally spaced relationship for substantially the full length of the launder. The hot face of the burner was therefore appproximately 27 square inches in total area. The radius of trough 18 of the launder was approximately two inches and the scale substantially that of FIG. 1. It has been found that any type of "grog" can be used to form the porous refractory for the burner, providing the fines are sifted out and the coarser grains are crushed to pass through a seive of suitable size. In the example actually constructed the grog used was "Hyal" insulating refractory material manufactured by Quigley Company, New York, N.Y., which had a composition as follows:

| | |
|---|---|
| Alumina ($Al_2O_3$) | 62.58% |
| Silica ($SiO_2$) | 30.75 |
| Iron Oxide ($Fe_2O_3$) | .8 |
| Calcium Oxide (CaO) | 3.92 |
| Magnesium Oxide (MgO) | .19 |
| Titanium Oxide ($TiO_2$) | .75 |
| Impurities | 1.01 |

This material was crushed until it would pass through a seive of 6-mesh having 0.035 wire. The material that passed through this seive was then passed over a 16-mesh screen having 0.018 wire to sift out the fines and flour. The remaining graded granular material was then covered with hot water, which permeated the particles, and was then drained off. To this hot, moist, gravelly matter there was then added calcium-aluminate cement, 25% by volume. After a thorough mising the mixture was placed in a steel mold the shape of the desired burner and then cured for 24 hours at 100°F. It was then placed in a firing kiln where the block was brought up to a temperature of about 2000°F. to complete curing. It was then assembled to the burner assembly by simply setting it in position and then pouring the surrounding refractory, indicated at 72, around it. This burner and launder was found to give very satisfactory results with molten brass (2250°–2350°F.) using 250 cubic feet per hour of natural gas and 2500 cubic feet per hour of air mixed together and supplied at standard pressure through a two-inch supply pipe.

Insulation 17 permits liner 16 to retain a substantial degree of the heat which it soaks up during operation of the launder, as a consequence of which it has been found feasible to turn the burner off at night. It has been discovered that after an overnight shut-down the launder can be brought back up to temperature in less than an hour. This is, of course, very beneficial from the standpoint of reducing the cost of fuel, insurance, and the like.

Because heating by convection is more efficient than heating by mere radiation, such as the infra red radiation utilized in convection luminous wall type furnaces, it is desired that in furnaces embodying the present invention the surface area of the combustion be reduced to a minimum. This effectively reduces the amount of radiation and increases thermal efficiency. The furnace of the present invention is also distinguishable from a conventional luminous wall furnaces (such as those illustrated in U.S. Pat. Nos. 2,828,813 and 1,225,381) because the present furnace does not require extra air solely for cooling, which is not only expensive but which also oxidizes the hot metal being heated in the furnace. Furthermore, as noted, the burner of the present invention is relatively narrow and preferably is of a minimum width, which is exactly the opposite of that sought in luminous wall furnaces where heating on all walls and maximum size combustion chambers are sought in order to increase radiation. Furthermore, the present furnace does not require any special reflective surfaces on the burner walls in order to reduce heat absorption and increase reflectivity and radiation. In addition, the present burner does not require numerous relatively large holes extending from the outside surface of the porous refractory to adjacent the hot surface in order to get proper fuel flow. As can thus be seen, the burner and furnace of the present invention utilize an elongated relatively narrow strip consisting of a myriad of small flames of relatively low velocity, with the result that there is no direct impingement of the flames upon the molten metal being heated, and an even distribution of heat is obtained throughout the length of the furnace with a relatively long dwell time of the heated combustion products in the furnace to facilitate the maximum of heat transmission to the metal being heated per unit of fuel consumed and thereby increase efficiency. If the present invention is embodied in a crucible melting furnace then the same general principles apply. In such a furnace, in which the combustion chamber is normally disposed exteriorly of the crucible, the burner would consist of a relatively narrow annular strip of porous refractory extending around the circumference of the outside furnace wall, the shape of such burner being determined in the same manner as with respect to the launder herein described. In both cases the burner extends for substantially the full extent of the combustion chamber in at least one direction. Furthermore, the porous refractory of which the burner is composed may be formed in a number of different manners. For example, it may be formed by casting a ceramic material around a large number of small rod-like elements which would thereafter be removed from the refractory to create a plurality of corresponding openings, or in some cases a large number of very small holes could be drilled in a refractory material to give the same result.

Thus, there is disclosed in the above description and the drawing an embodiment of the invention which fully and effectively accomplishes the objects thereof. However, it will be apparent that other variations in the details of the construction may be indulged in without departing from the scope of the invention herein described or the scope of the appended claims.

I claim:

1. A burner comprising: housing means defining a substantialy rigid enclosure and including wall means terminating in a common plane to define an open end to said enclosure, the opposite end of said enclosure being closed; an elongated strip of porous refractory material disposed in said enclosure, said strip of refractory material having an elongated generally flat hot face lying generally in said common plane, a cold face disposed on the opposite side of said strip from said hot face, and side faces of said strip disposed therebetween, said strip being wholly spaced from said wall means, said strip having a plurality of fuel flow passages extending therethrough from said cold face to said hot face, said hot and cold faces being spaced apart a distance greater than the width of said hot face; a body of heat insulating material disposed between said side faces of said strip and said wall means, said body of insulating material being relatively light in weight and filling the entirety of the space between said strip and said wall means, one surface of said body of insulating material lying generally in said common plane and the opposite surface of said body being at least in part spaced from said opposite end of said enclosure to define a plenum; and inlet means having a flow passageway for communicating a gaseous fuel to said plenum.

2. A burner as claimed in claim 1, wherein said one surface of said body lies in substantially the same plane as said cold face of said strip.

3. A burner as claimed in claim 2, wherein said last-mentioned plane is generally parallel to said common plane.

4. A burner as claimed in claim 3, wherein said body of insulating material fills the major portion of the space defined by said wall means and said two planes.

5. A burner as claimed in claim 1, wherein said side faces of said strip are disposed in spaced planes which converge toward one another in a direction toward said common plane.

6. A burner as claimed in claim 1, wherein said hot and cold faces are spaced apart at least three and one-half inches.

7. A burner as claimed in claim 1, wherein said strip is of substantially uniform density and porosity throughout its thickness in a direction extending from said cold face to said hot face.

8. A burner as claimed in claim 1, comprising a plurality of said elongated strips of said porous refractory aligned with respect to one another in a longitudinally disposed end-to-end spaced relationship, said non-porous refractory material being disposed between said strip.

9. A burner as claimed in claim 1, wherein the total effective cross-sectional area of the passageways through said porous refractory is greater than the approximate total effective area of said flow passageway for inlet fuel through said inlet means.

10. A burner as claimed in claim 1, wherein said strip of porous refractory is of substantially uniform cross-section throughout its length.

11. A burner as claimed in claim 1, wherein said strip is longer than said distance between said hot and cold faces.

12. A burner as claimed in claim 1, wherein said heat insulating material has a hot surface which is substantially flush with said hot face.

13. A burner as claimed in claim 1, wherein said hot and cold faces are disposed generally parallel to one another.

14. A burner as claimed in claim 1, wherein said strip is formed of a porous refractory material.

15. A burner as claimed in claim 1, wherein said fuel flow passages are cast holes in said strip.

16. A burner as claimed in claim 1, wherein said fuel passages are drilled holes in said strip.

17. A burner as claimed in claim 1, wherein said burner is utilized for supplying heat to a combustion chamber, said strip extending for substantially the full length of one dimension of said combustion chamber, said hot face being of a minimum width sufficient to pass the desired quantity of gaseous fuel.

18. A burner as claimed in claim 9, wherein said area of said passageways in said porous refractory approximately 150 percent of the area of said flow passageway for inlet fuel.

* * * * *

UNITED STATES PATENT OFFICE

CERTIFICATE OF CORRECTION

PATENT NO. : 3,954,388

DATED : May 4, 1976

INVENTOR(S) : Kornelius Hildebrand

It is certified that error appears in the above-identified patent and that said Letters Patent are hereby corrected as shown below:

Column 6, line 48, "substantialy" should be --substantially--

Column 8, line 30, insert "is" before the word "approximately"

Signed and Sealed this

Seventeenth Day of August 1976

[SEAL]

*Attest:*

RUTH C. MASON
*Attesting Officer*

C. MARSHALL DANN
*Commissioner of Patents and Trademarks*